US005104125A

United States Patent [19]

Wilson

[11] Patent Number: 5,104,125

[45] Date of Patent: Apr. 14, 1992

[54] THREE-DIMENSIONAL POLYHEDRAL JIGSAW-TYPE PUZZLE

[76] Inventor: John Wilson, 500 Hensley Ave., Apt. #1, San Bruno, Calif. 94066

[21] Appl. No.: 464,905

[22] Filed: Jan. 16, 1990

[51] Int. Cl.[5] ..... A63F 9/12

[52] U.S. Cl. ..... 273/157 R; 446/120; 446/125

[58] Field of Search ..... 273/157 R, 155, 156, 273/160, 273; 446/118, 119, 120, 125, 127, 487, 108, 109, 111; 434/211

[56] References Cited

U.S. PATENT DOCUMENTS

| | | | |
|---|---|---|---|
| 1,292,188 | 1/1919 | Wheeler | 434/211 |
| 1,638,743 | 8/1927 | Peterson et al. | 273/155 |
| 3,547,444 | 12/1970 | Williams et al. | 273/160 |
| 3,578,331 | 5/1971 | DeGast | 273/157 R |
| 3,618,955 | 11/1971 | Barnes | 273/157 R |
| 3,924,376 | 12/1975 | Tsurumi | 52/593 |
| 4,456,258 | 6/1984 | Lodrick | 273/241 |

*Primary Examiner*—Edward M. Coven

*Assistant Examiner*—William M. Pierce

[57] ABSTRACT

A multi-set assembly puzzle (100) whose flat pieces correspond to the panels of a soccer ball. A 32 piece complement comprises 20 hexagons (102) and 12 pentagons (104). Grooves (112) in all polygon sides (110) must have a cylinder (114) attached in it's right (R) else left (L) portions. Sides (110) adjoin only RR else LL. Adjoining pieces may be coupled by inserting a single connecting pin (120) through their aligned cylinder's centers (118). The Rs and Ls of the polygons' sides (110) may be configured to produce 22 different subspecies. The sides (110) are grouped in 90 adjoining pairs which are randomly assigned R else L. The polygon subspecies are then found by examining the Rs and Ls of their sides, and their quantities become the specification for the complement. Successive specifications are compared to all previous specifications. Identical specifications are eliminated, but the former set has another solution, and is rated less difficult. A set, its specification, its solutions, and its difficulty rating are associated by a serial number.

6 Claims, 11 Drawing Sheets

THREE-DIMENSIONAL POLYHEDRAL JIGSAW-TYPE PUZZLE

CROSS-REFERENCE

A document evidencing conception of this invention was filed in the U.S. Patent Office Disclosure Document Program Nr. 184578 on Jan. 15, 1988.

BACKGROUND-FIELD OF INVENTION

This invention relates generally to three dimensional assembly puzzles, and specifically to hollow geometric structures whose surfaces are composed of regular polygon pieces that are joined at their edges.

BACKGROUND-PRIOR ART

Heretofore due to design deficiencies, three dimensional puzzles of the hollow geometric structure variety have not been particularly challanging. Consider for example the cuboidal structure of Tsurumi U.S. Pat. No. 3,924,376. This puzzle has only three distinct "square" piece varieties. From the point of view of the manufacturer, the pieces present difficulty because each "square" has at least twenty edge segments. But from the point of view of the puzzle solver, this puzzle is too easy because the set comprises merely six pieces.

Likewise, the spherical structure disclosed by DeGast U.S. Pat. No. 3,578,331 is, according to claim 1 thereof, to be " . . . a plurality of identical four-sided puzzle pieces . . . " Here again the puzzle poses little difficulty. Its assembly is simply a matter of placing the pieces side by side as in tiling a floor. Of course, there are other ways to configure the projections and recesses, but these alternatives were rejected in the third paragraph of Background Of The Invention section.

Doubts also arise regarding the practicality of interlocking the projections and recesses. The reader will see that it appears to be impossible to assemble the third triangle of the triangular portions or the fifth triangle of the pentagonal portions. The reason for this is because the edges of the projections and recesses aren't parallel. The inner perimeters of the pieces are smaller than the outside perimeters of their respective niches. The consequence of this arrangement is that the projections and recesses cannot be aligned (as in a common jigsaw puzzle) in order to fit the final pieces into their respective niches.

OBJECTS AND ADVANTAGES

Accordingly, several objects and advantages of the present invention are to provide:

1 a challanging assembly puzzle that is difficult, confusing, perplexing, frustrating, exaspirating, confounding, and the like.

2 a puzzle whose polygons appear to be identical hexagons and pentagons, but which may be comprised of 22 distinctively different archetype polygons.

3 a puzzle that is easy to manufacture, because its 22 archetype polygons comprise only three basic components connected by a fourth.

4 a puzzle whose sets seem to be identical but are in fact all distinctly different or unique so that every set requires a specific unique individual solution. (So that no set's pieces have a one-to-one correspondance to those of any other set.)

5 a puzzle whose every unique set has its own unique solution diagram.

6 a puzzle whose every unique set has a serial number that is associated with its solution diagram.

7 a puzzle whose inter-locking mechanism is demonstrably operable.

8 a puzzle having a great number (more than a million) of possible sets.

9 a puzzle whose every unique set may be assigned a difficulty rating depending upon the number of its solutions.

10 a puzzle designed to resemble a soccer ball.

11 a puzzle whose dimensions are well defined.

12 a puzzle having an associated method of generating random sets and their solutions diagrams.

Further objects and advantages of my invention will become apparent from a consideration of the drawings and ensuing discription of it.

Figures 1, 1A:
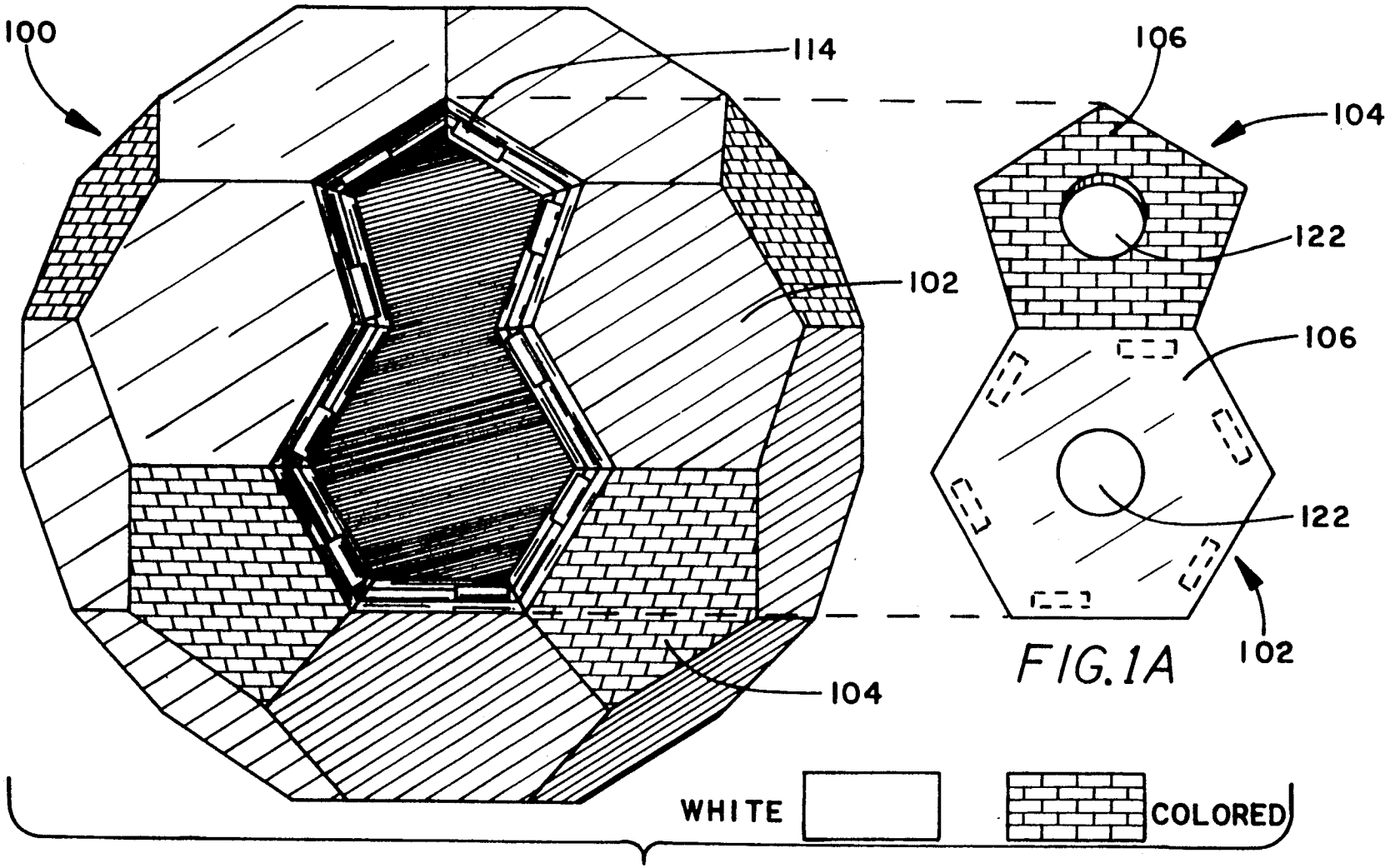
FIG. 1 shows partially assembled isometric view of puzzle with two pieces removed.

LIST OF REFERENCE NUMERALS 100 puzzle
102 hexagon
104 pentagon
106 piece's outer surface
108 piece's inner surface
110 piece's side
112 groove
114 cylinder
116 cylinder's outer surface
118 cylinder's center
120 connecting pin
122 piece's removal hole

DESCRIPTION OF THE INVENTION

The puzzle is of convenient size for manipulation having a piece side length of 3 to 4 centimeters, and a height of approximately 16 to 18 centimeters.

Like a soccer ball's panels, this puzzle has 32 pieces that are closely associated with an equal number of specific niches. There are 20 white hexagons and 12 black pentagons. The length of their sides are equal like the panels of a soccer ball. The vertices or corners of the pieces are equidistant from the center of the puzzle like the radii of a soccer ball.

FIG. 1 shows a front side view of the substantially assembled puzzle 100. The pieces 102 and 104 are arranged in the typical soccer ball's panel's configuration but their surfaces are flat. The black pentagons 104 are surrounded by white hexagons 102, but hexagons 102 are surrounded alternatingly by pentagons 104 and hexagons 102. One or more pieces may have a removal hole 122 for disassembly.

Figure 2:
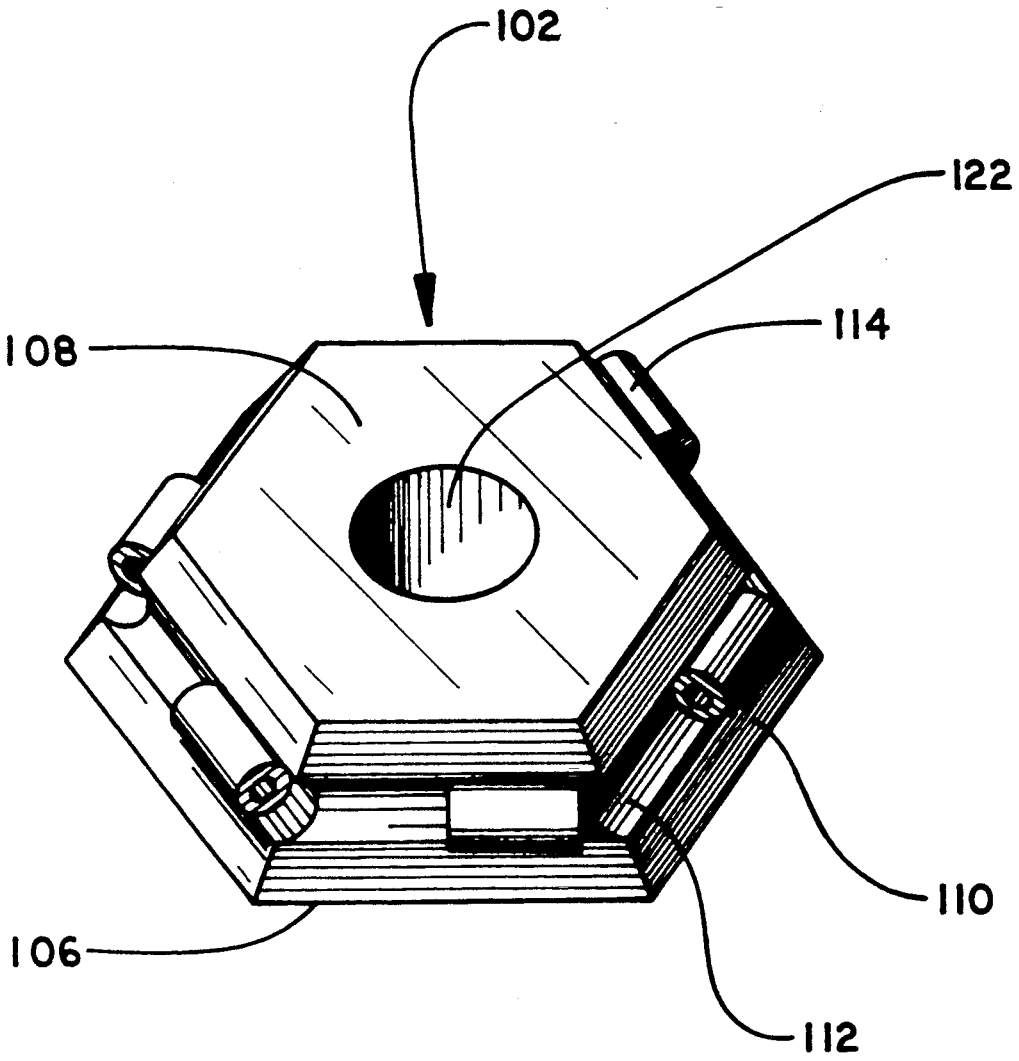
FIG. 2 shows isometric view of removed hexagon of FIG. 1 with all cylinders at right (R) groove position. (See also type I of FIG. 9)

FIG. 2 shows the removed hexagon 102 of FIG. 1 resting on its outer surface 106. The reader will see that its sides 110 have an inward slope. This slope is inclined 69° 15′ to the horizontal.

Figure 3:
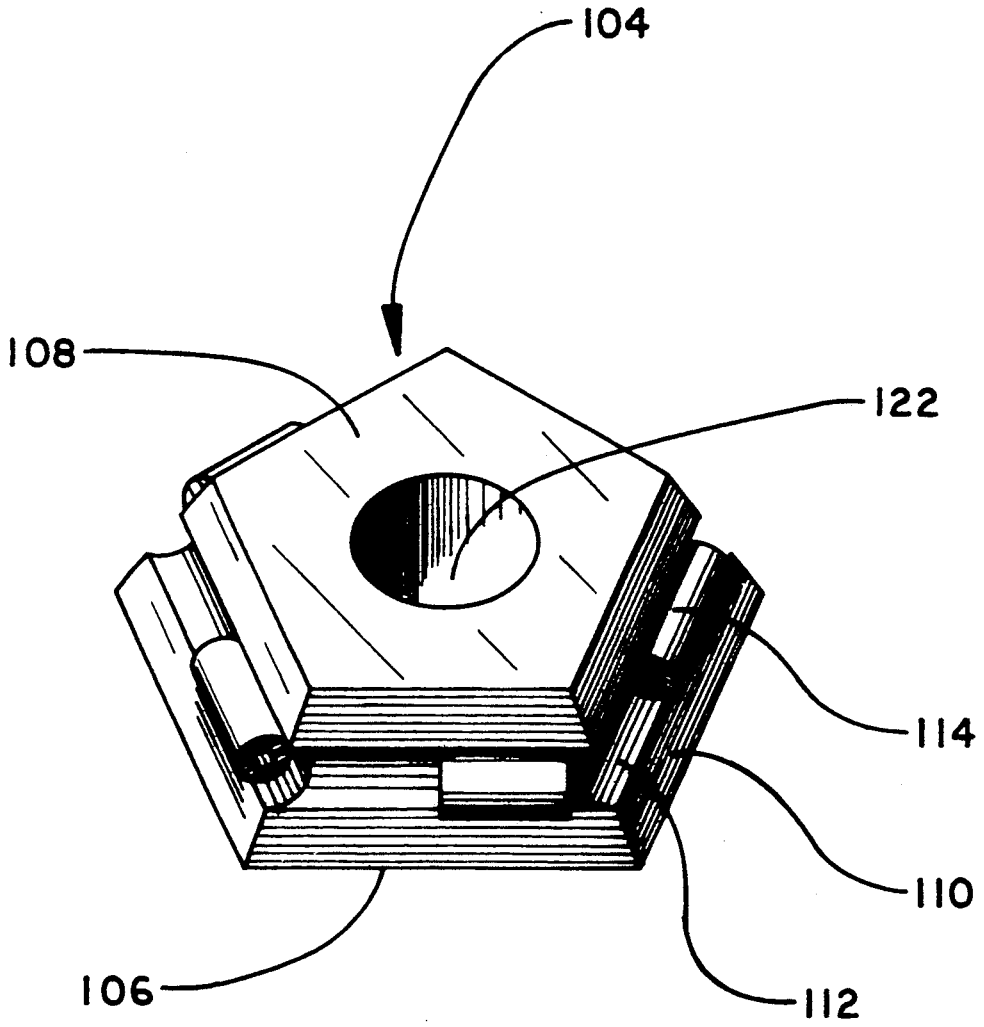
FIG. 3 shows isometric view of removed pentagon of FIG. 1 with all cylinders at right (R) groove position; (See also type XV of FIG. 10.)

FIG. 3 shows the removed pentagon 104 of FIG. 1. Its slope is inclined 71° 39′ to the horizontal, or slightly more than the hexagon's. These inclination angles allow the sides of adjacent pieces to lie together as parallel planes.

FIGS. 2 and 3 show that both pieces have semicircular horizontal grooves 112 on all sides. These grooves are located centrally between the inner 108 and outer 106 piece surfaces. A groove must have a cylinder 114 permanently attached to either its right or left portion. The grooves contour matchs the cylinders outer surface 116.

Figure 4:
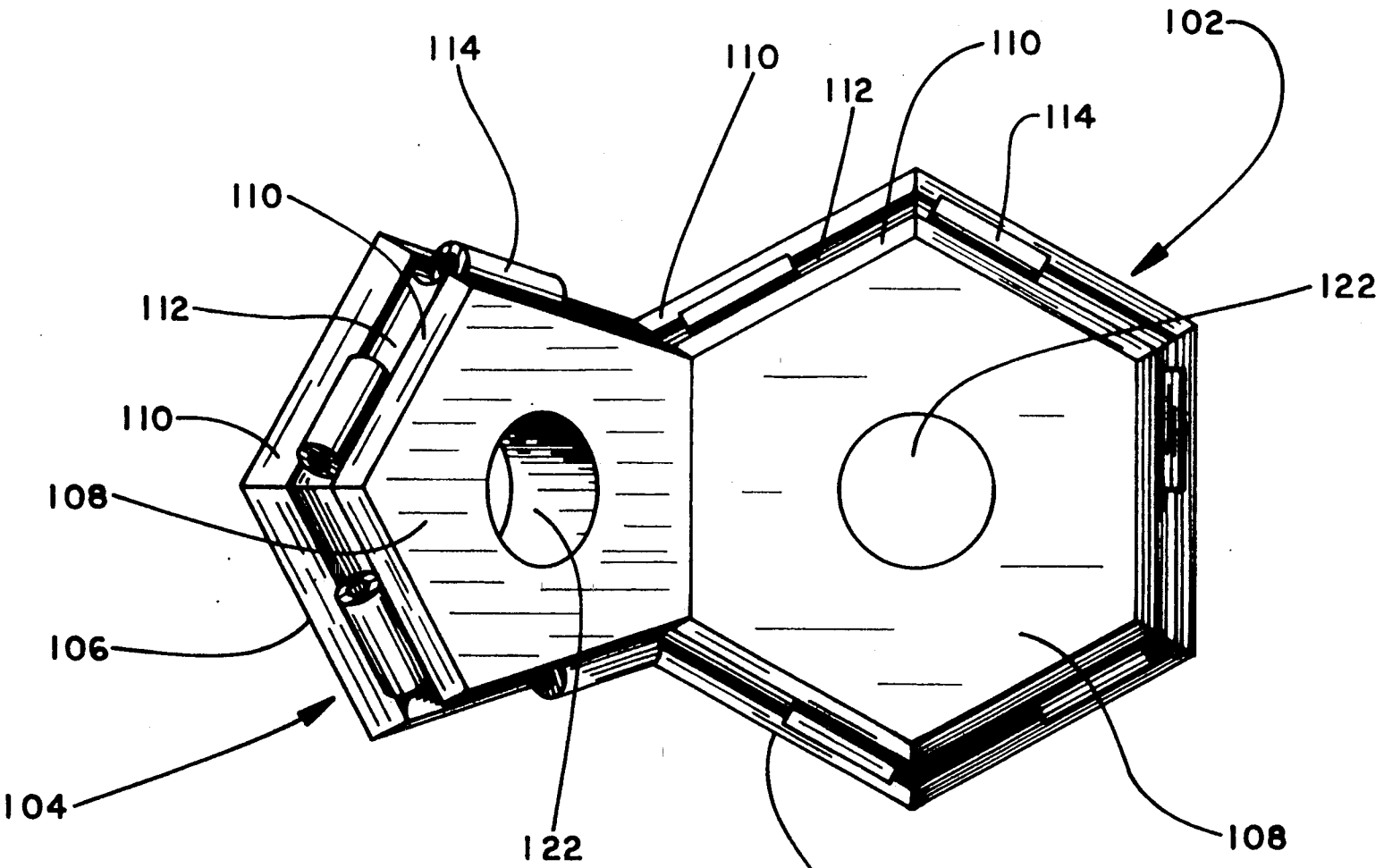
FIG. 4 shows isometric view of the coupled pieces of FIGS. 2 and 3.

FIG. 4 shows a inner view of the two piece subassembly of FIGS. 2 and 3. (FIG. 1 shows it's outer view.)

Figure 5:
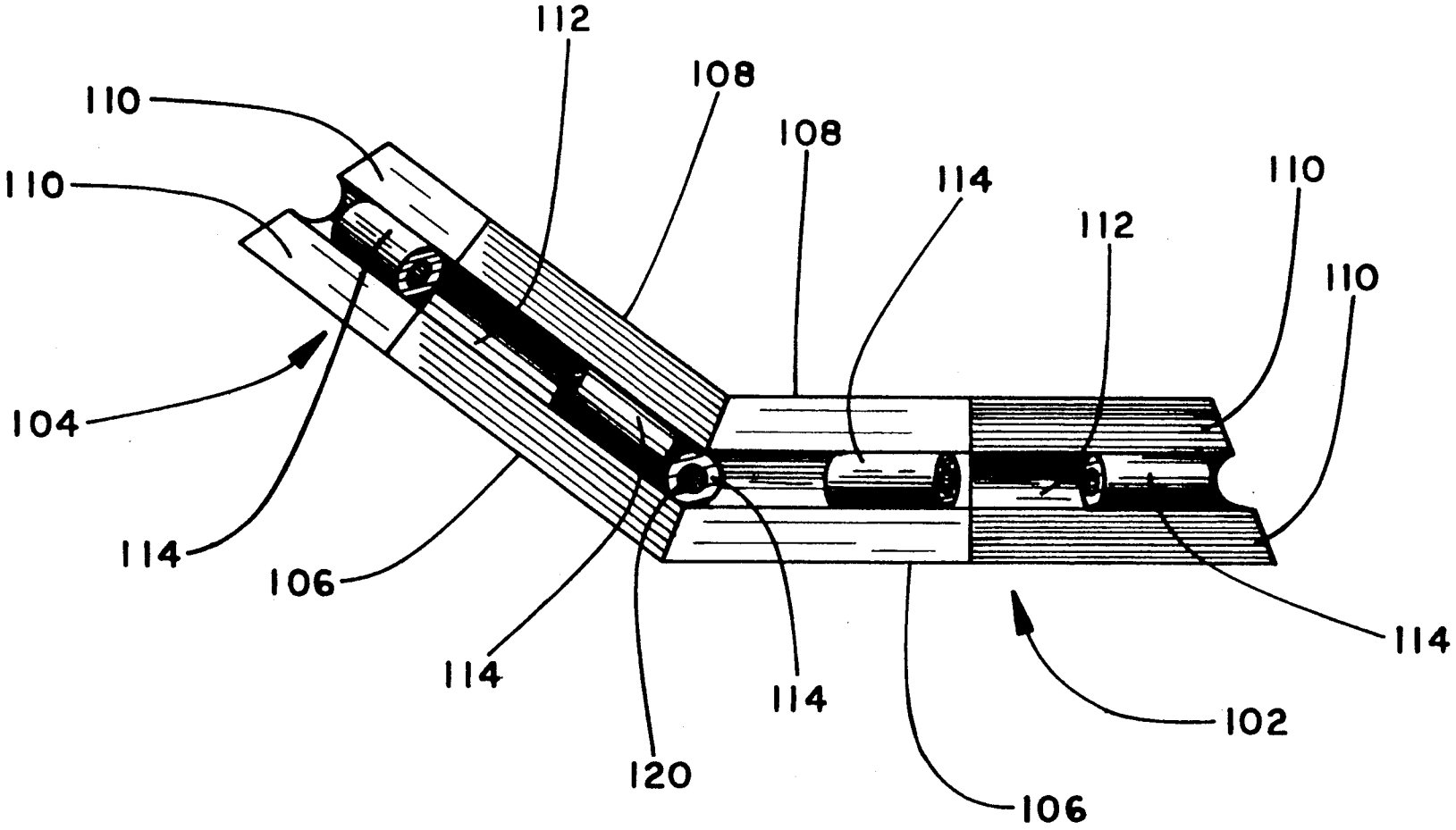
FIG. 5 shows isometric view of pieces of FIG. 4 with end view of connecting pin.

FIG. 5 shows a side view of the two piece subassembly of FIG. 4, and in particular an end view of the connecting pin 120 that couples them.

Figure 6A:
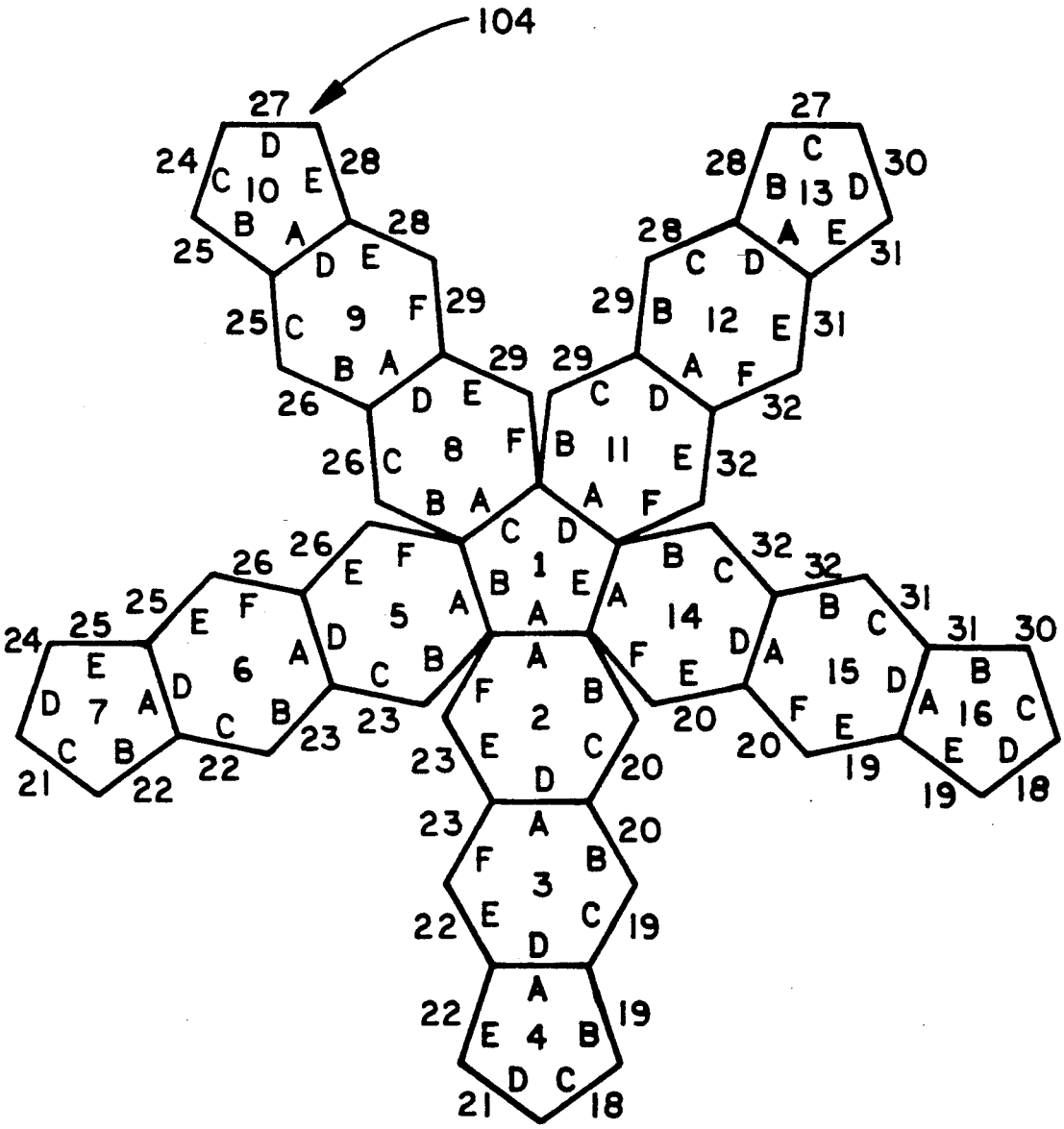
FIG. 6 shows two part puzzle diagram of lower half (left group) and upper half (right group) of numbered piece-niches and their side letters.
Figure 6B:
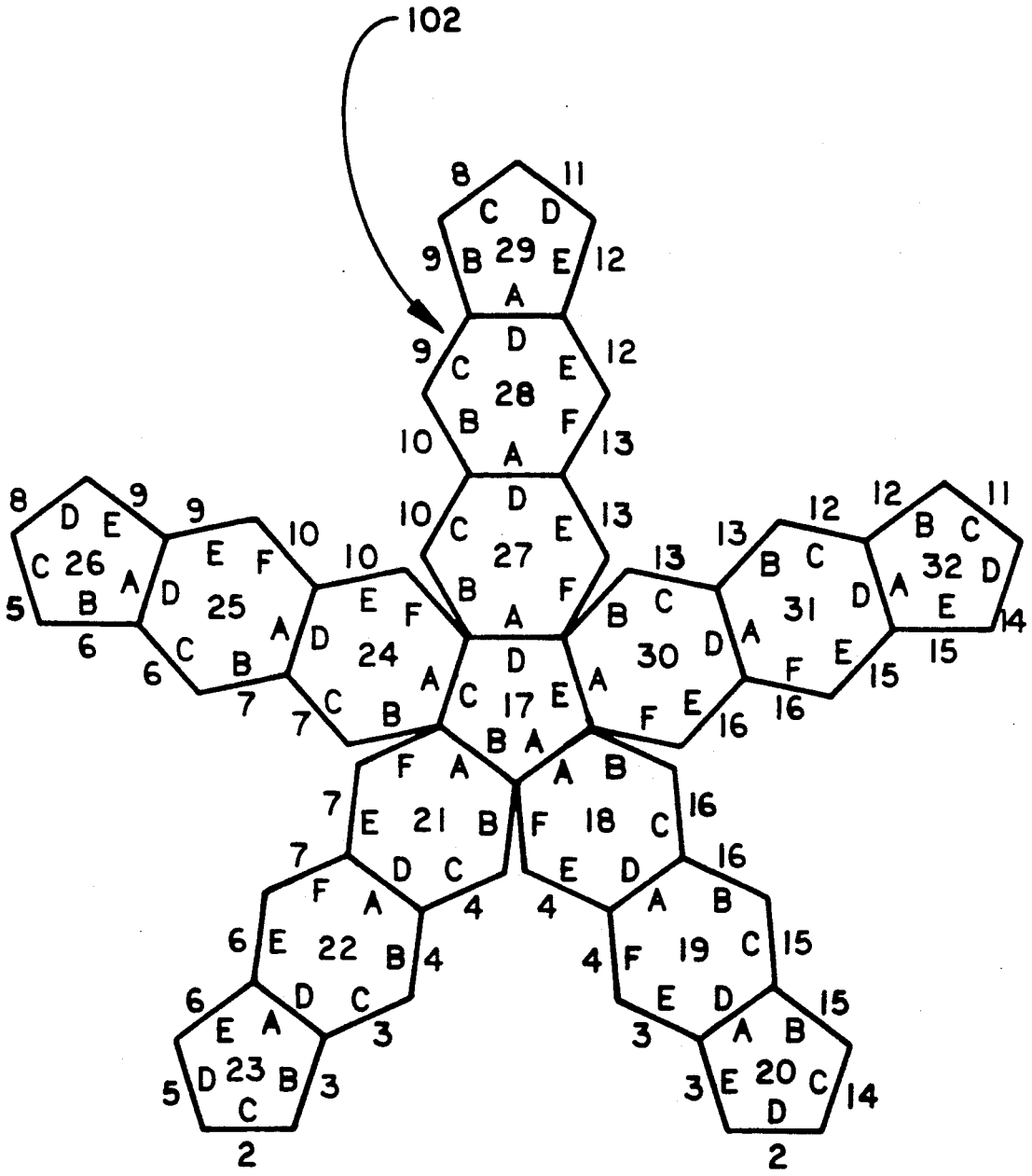

FIG. 6 shows a two part diagram of the puzzle 100. The left group of the diagram, piece-niches 1 through 16, depicts a top inner view of the lower half of the puzzle 100. Piece-niche number 1 corresponds to the base pentagon of the puzzle of FIG. 1. Numbers 3 and 4 correspond to the two piece subassembly. The right group of the diagram, piece-niches 17 through 32, depicts a top outer view of the upper half of the puzzle. Generally, the piece-niches are consecutively numbered outwardly and clockwise from their group's centers. Numbers outside a piece-niche's perimeter indicate adjacent piece-niches in the opposite half's group.

Figure 7A:
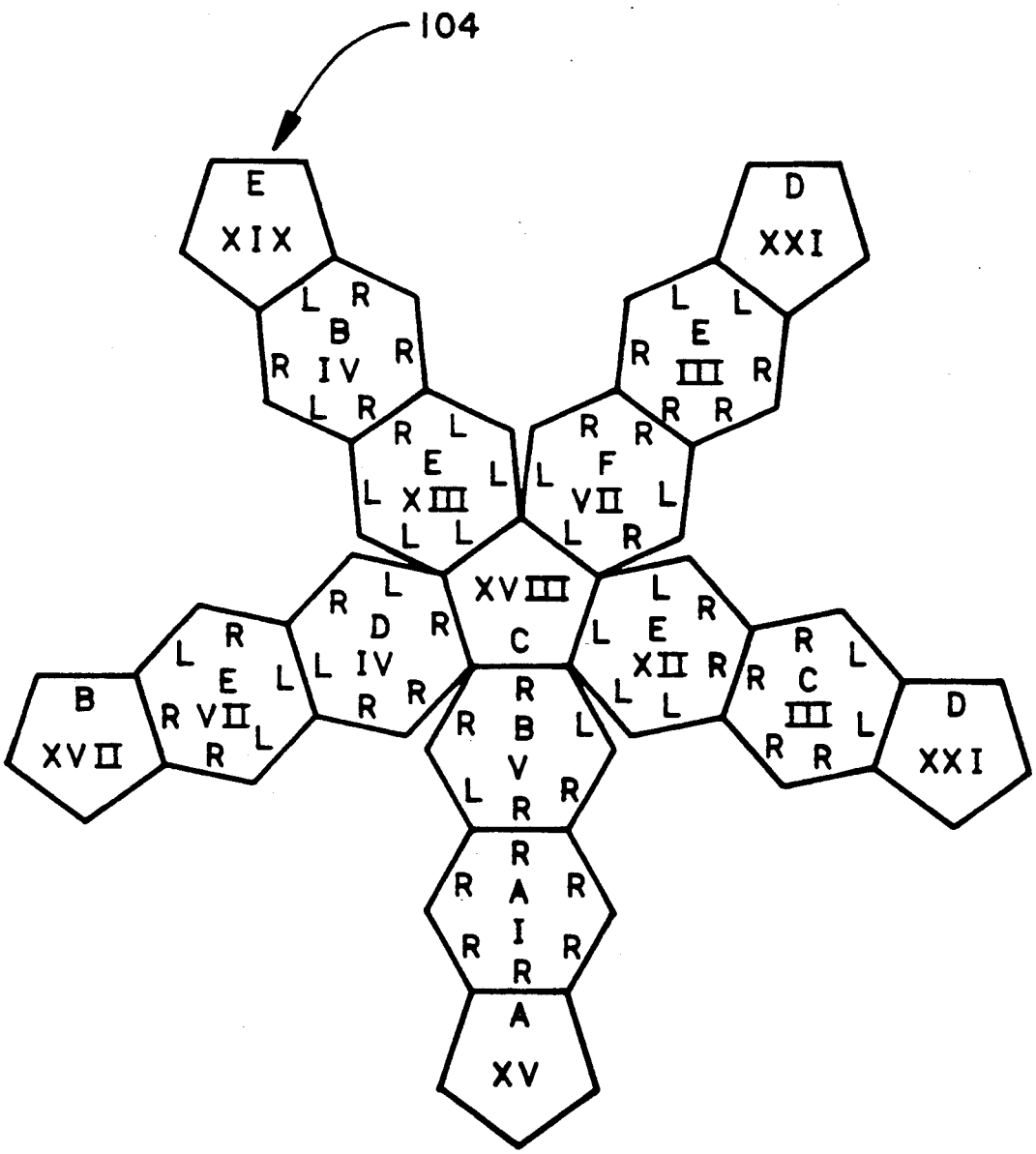
FIG. 7 shows diagram of FIG. 6 but with Roman numeral piece types, subspecies letters, and character strings.
Figure 7B:
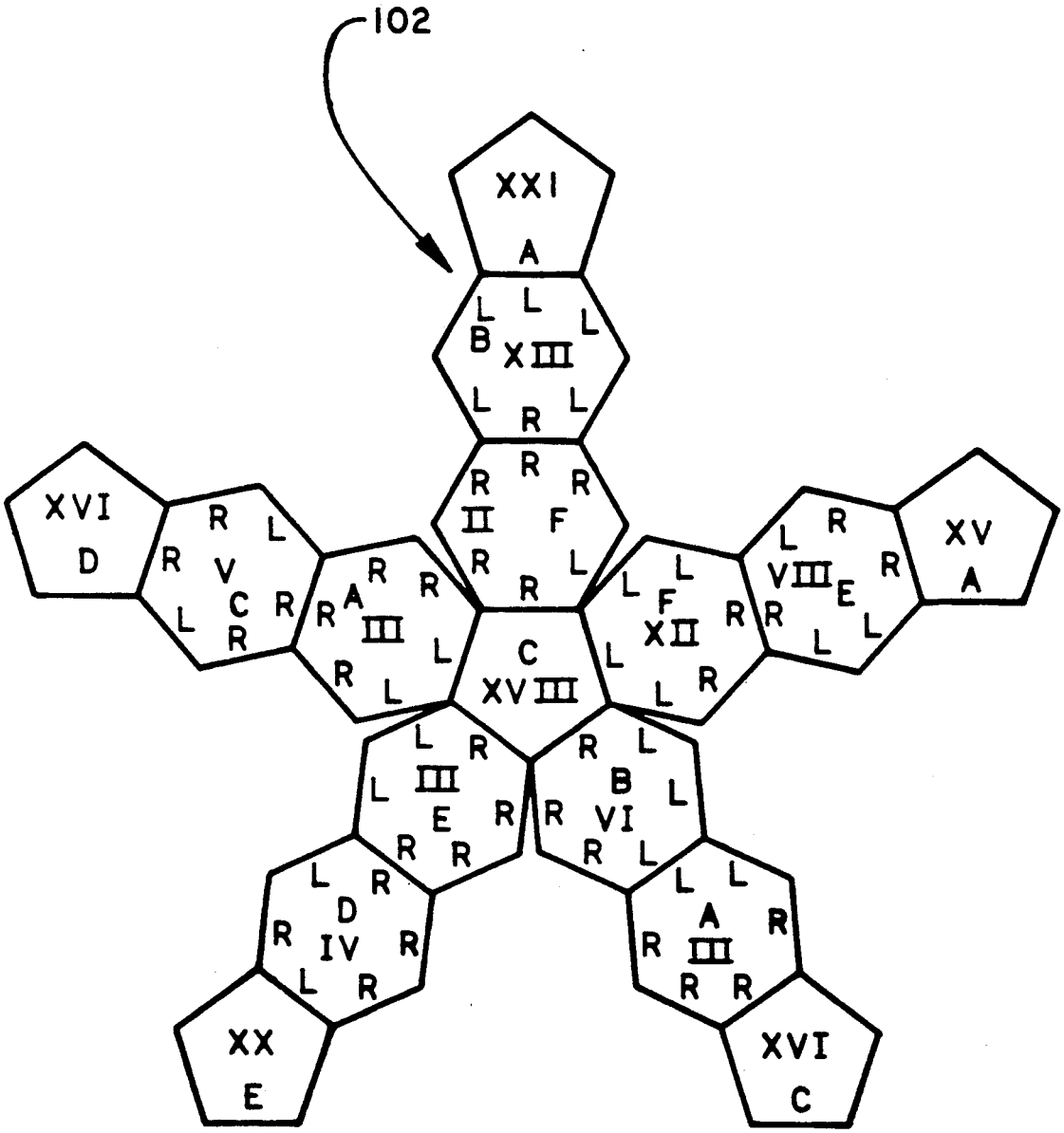

FIG. 7 shows a full solution diagram of the illustrated puzzle's set. Because every pentagon adjoins five hexagons, the Rs and Ls of the hexagons apply also to the pentagon sides they adjoin.

Figure 8:
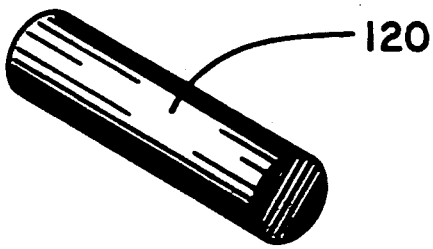
FIG. 8 shows isometric view of connecting pin.

FIG. 8 shows the connecting pin 120 as seen in FIG. 5. This pin snuggly fits the cylinder's center 118.

Figure 9:
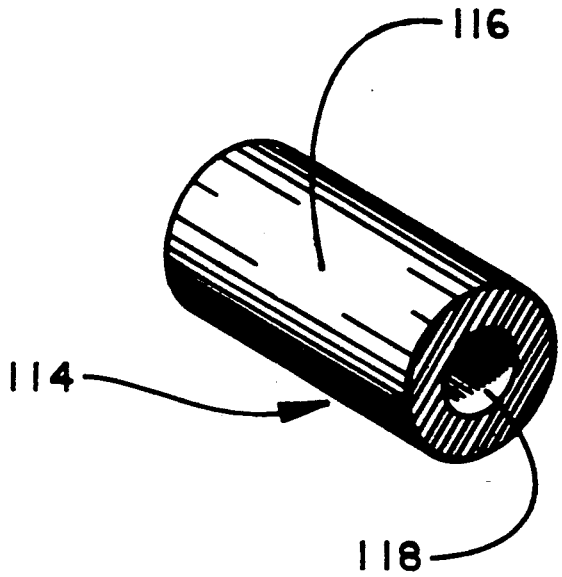
FIG. 9 shows isometric view of cylinder.

FIG. 9 shows the cylinder 114. The cylinder's length is approximately 45% of the groove's length 112. The cylinder's center 118 accomodates the connecting pin 120. The cylinder's outer surface 116 matchs the contour of the groove 112.

Figure 10:
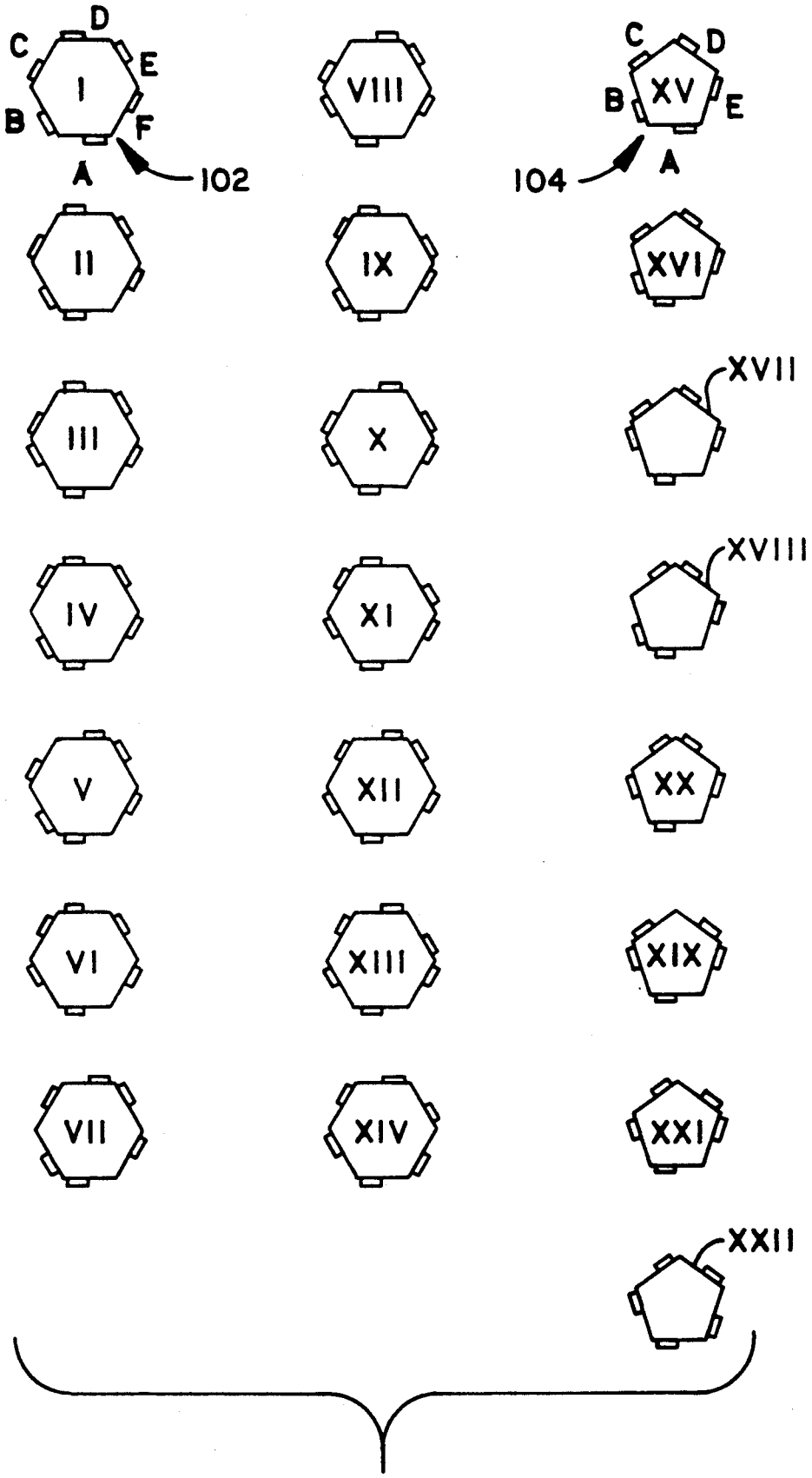
FIG. 10 shows diagram of all 14 hexagon types and all 8 pentagon types.

FIG. 10 shows diagrams of all 14 hexagon types which are denoted by Roman numerals I through XIV. FIG. 10 also shows all 8 pentagon types which are denoted by Roman numerals XV through XXII.

OPERATION OF THE INVENTION

Components

As seen above, there are only four puzzle components from which the 22 polygon types are made. These four are hexagons, pentagons, cylinders, and connecting pins. A cylinder must be permanently attached to the R or L portion of all grooves. Diagrams of all piece types are found in FIG. 10. The attached cylinders give the piece's sides 110 R- or L-handedness. Sides may adjoin RR else LL. When sides adjoin, their cylinders are aligned. The pieces may then be coupled by inserting a single pin 120 through both their centers 118.

Difficulty

This R-L configuration creates confusion for the solver because the R and L sides are difficult to differentiate. Unlike the well known tongue-and-groove design, different piece types appear to be identical. The puzzle is to be sold fully assembled. And it is designed to appear disarmingly simple. The solver will probably fail to differentiate among similar pieces when disassembling the puzzle. The solver then will become hopelessly confused when attempting to reassemble the set. The odds against solving virtually any unique set are astronomical. If the solver has not carefully identified all pieces, the odds against reassembling just one pair are prohibitive.

Set's Complements

The reader will appreciate that some groupings of 20 hexagons and 12 pentagons are false complements because they have no solution. One such group could be comprised of 31 all R pieces and 1 all L piece. The puzzle could be easily assembled except the all L piece that couldn't be coupled anywhere. Conversely, some set complements are false puzzle because confusion is negligable. An example would be an all R set. It is therefore desirable for the manufacturer to determine that any set is unique and difficult, but solvable.

Set Generation

Methods are provided for generating unique sets deliberately or randomly with particular reference to side's pair grouping. In a sense, the solution preceeds the puzzlement as disclosed below.

Unique Sets

A unique set is defined as a 32 piece complement whose piece types do not have a one-to-one correspondance to those of any other set.

Piece Types

The reader will appreciate that the piece types diagramed in FIG. 10 exhaust every possible variation of R and L side combination. These types are represented by Roman numerals I through XXII. They are also represented by their character strings- the Rs and Ls of their sides written in clockwise alphabetical loop order.

Character Strings Table

The Rs and Ls character strings of the lines represent the piece types of FIG. 10. The handedness of the types progresses gradually from all Rs to all Ls. Most of the types have a number of different "looks" in columns BCDEFA through FABCDE depending on which side's R or L begins the character string. FA and EA are also considered clockwise and alphabetical. All possible variations of character strings must appear in this table.

Pairs List

The key to understanding this puzzle is to recognize that piece's sides are grouped in pairs. There are 90 pairs per puzzle complement. They are itterated alphanumerically in the pairs list. Because adjacent sides define a pair, they must be RR else LL. The elements of a pair are two sets of piece's side's co-ordinates. The co-ordinates of a piece's side are simply the piece-niche number followed by the side letter: "3A." (See FIG. 6.) The pairs first element has the lower piece-niche number:

"1A-2A." The adjacent pair of the subassembly is: "3A-4D."

R else L Pair designation

The pairs may be designated R else L deliberately or randomly. When all the pairs have been designated, the pairs list defines both a solution and a set. The illustrated set's pairs were randomly assigned Rs and Ls except the subassembly pairs. These were all labled R for simplicity. To generate another probably unique set, the Rs and Ls are simply reshuffled. In this sense, the solution preceeds the puzzlement.

Mathematical Observations

The likelyhood of randomly generating identical pairs lists is 1 in $2^{90}$ (1,237,940,000,000,000,000,000,000,000.) These lists always represent solutions, but the number of unique sets is considerably less. While I believe that the ratio of solutions to sets is approximately 9,590,846,-100,000,000. to 1, I do not wish to be bound by this. Though it is probably accurate to say that a difficult unique set could be defined for every person in the world.

Identifying Set's Piece Types

To identify the types of the pieces that comprise the set defined by the pairs list, the Rs and Ls are reproduced in the identification table.

Transfering Rs and Ls To The Identification Table

The 32 pieces comprising the unique set's complement are to be represented in the identification table by 32 lines of character strings. The columns ABCDE and F represent the sides of the pieces. Example 1): pair 1A-2A is R, so R is written in the "A" column of lines 1 and 2 of the identification table. Example 2): pair 1C-8A is L, so L is written in the "C" column of line 1 and the "A" column of line 8. When the Rs and Ls of all the sides are written their correct lines and columns, (tabular co-ordinates) the types of the 32 pieces are readily identified by their character strings.

Character String Search

All strings of 5 or 6 characters are to be found in the character strings table. A character string is identified by it's line's Roman numeral and the letter of the side that begins it. The character string RRLRL- of line 1 in the identification table is found in line XVIII, columns CDEAB of the character strings table. This type then is XVIII for the line, and subspecies C for the side that begins the string. Or simply: XVIII-C.

The Set's Specification

The set specification is simply the type and quantity of the pieces that comprise it. This information comes from the completed identification table. The types data of the illustrated puzzle appear in the set's specification. The quantities of the set's specific types equals the set's complement equals 32. Types indicated by pound (#) and star (*) signs show how quantity of types data are transfered from the identification table to the set's specification.

Verifying The Solution

FIGS. 6 and 7 were designed to convey the set's solution in a simple uncluttered format. Sets are assembled prior to sale, so a diagramed solution as in FIG. 7 is made for each set. The pieces are then put in their correct positions at their correct orientations by also refering to FIG. 6.

Full Solution Diagram

FIG. 7 shows the upper and lower halves of the puzzle as in FIG. 6, but the now familiar piece-niche-side co-ordinates are unlabled.

Instead, the type numerals and subspecies letters from the identification table appear. This solution is comprehensive because it shows the piece's types and subspecies.

Partial Solutions

One partial solution of a set would be to show the types of the pieces in the niches, but neither the subspecies nor the Rs and Ls. Another partial solution would be to show all the pair's Rs and Ls but neither the types nor the subspecies.

Records

Records are to be maintained of every set's specification, its number of known solutions, and its comprehensive solution diagram. To associate a set and it's records, they are all given the same serial number.

Unique Set's

Reshuffling the Rs and Ls of the pairs list probably defines a unique set. But this isn't neccessarily so. To avoid set duplication, every set's specification is compared to every previous set's specification. A duplicate specification may be discovered. If so, the first set is said to have 2 solutions. The later specification is eliminated, and so on.

Difficulty Rating

This number is 100 devided by the number N of known solutions: 100/N. The highest difficulty rating is 100 for a set with only 1 known solution.

Assembly

The reader will see that the two piece subassembly cannot be coupled with connecting pins to the two piece niche. But if the subassembly is uncoupled, one of its pieces may then be coupled with the "soccer ball." The last piece is "snapped" into place. This is made possible because the cylinders are flexible. The adjacent cylinders flex when the last piece is pressed into its niche. They then recover their shape fitting securely into the grooves of their adjoining pieces. The reader will appreciate that the hexagons of a puzzles set could all coupled to one-another on three alternate sides. This arrangement substantially completes the "soccer ball" shape without incorporating pentagons. The pentagons could then be "snapped" into place without being coupled.

Manufacturing

A model of the disclosed embodiment was manufactured of wooden pieces, flexible plastic cylinders, and wooden connecting pins. The pieces were cut on a compound miter saw so that the polygons' exterior angles and inclination angles were cut in one operation. The grooves were cut in the sides of the pieces by passing them over a stationary router bit. Segments of flexible tubing of convenient size were then glued into the grooves according to the illustrated solution. The puzzle required 60 connecting pins. The four discrete components allow for simple plastics molding. The cylinder stock and connecting pin stock is available "offthe-shelf."

Computerized Operation

The Operation Of The Invention as disclosed is conducive with electronic data processing. Manufacturing and assembly can be done by computer controled machines.

SUMMARY, RAMIFICATIONS, AND SCOPE OF THE INVENTION

The reader will see that that the invention's 'objectives have been met.

1 The puzzle is very difficult, most probably requiring a solution diagram because the probability of correctly assembling any 2 pieces by chance is very low.

2 While appearing to be comprised of regular hexagons and pentagons, these polygons are only nominally regular. Any unique set may be selected from 22 subspecies.

3 Conversely, the 22 types are easy to make because they have only 3 components—hexagons, pentagons, and cylinders. Cylinders are available "off-the-shelf."

4 Although the sets appear to be identical, they are all unique.

5 Any solution is set specific and cannot solve any other set.

6 A set and its solution are identified by their serial numbers.

7 The inter-locking mechanism of the set is workable, but the solver has to discover it.

8 There is a very large number of unique sets. This is inferred by the number of piece types. I believe that the number of unique sets is well over 1,000,000.

9 A set's difficulty rating is simply 100 devided by the number N of its known solutions.

10 Assembled puzzles bear resemblance to a soccer ball.

11 The dimensions and in particular the inclination angles of the polygons, are well defined.

12 A method of randomly generated sets and their solution diagrams is disclosed.

Although the description above contains many specificities, these are not to construed as limitations of the scope of the invention but merely as illustrations of the prefered embodiment of the invention.

For example, the sets need not be unique to satisfy the "soccer ball" shape. Nor is it neccessary for sets to be difficult. A different hollow geometric structure might be specified. A sphere could be approximated by 32 equilateral triangles.

The sets could be randomly generated as with the "soccer ball." Tongue-and-groove pieces, though easier to differentiate, could substitute for the R else L sides. The polygons could have more sides or fewer, and so on.

Thus the scope of the invention should be determined by the appended claims and their legal equivalents, rather than limited by the illustrated disclosure per se.

Character Strings Table

| | Hexagon Subspecies | | | | | | |
|---|---|---|---|---|---|---|---|
| Types | ABCDEF | BCDEFA | CDEFAB | DEFABC | EFABCD | FABCDE | "Looks" |
| 1 I | RRRRRR | ——— | ——— | ——— | ——— | ——— | 1 |
| 2 II | LRRRRR | RRRRRL | RRRRLR | RRRLRR | RRLRRR | RLRRRR | 6 |
| 3 III | LLRRRR | LRRRRL | RRRRLL | RRRLLR | RRLLRR | RLLRRR | 6 |
| 4 IV | LRLRRR | RLRRRL | LRRRLR | RRRLRL | RRLRLR | RLRLRR | 6 |
| 5 V | LRRLRR | RRLRRL | RLRRLR | ——— | ——— | ——— | 3 |
| 6 VI | LLLRRR | LLRRRL | LRRRLR | RRRLLL | RRLLLR | RLLLRR | 6 |
| 7 VII | LRLLRR | RLLRRL | LLRRLR | LRRLRL | RRLRLL | RLRLLR | 6 |
| 8 VIII | LLRLRR | LRLRRL | RLRRLL | LRRLLR | RRLLRL | RLLRLR | 6 |
| 9 IX | LRLRLR | RLRLRL | ——— | ——— | ——— | ——— | 2 |
| 10 X | LLRLLR | LRLLRL | RLLRLL | ——— | ——— | ——— | 3 |
| 11 XI | LLLRLR | LLRLRL | LRLRLL | RLRLLL | LRLLLR | RLLLRL | 6 |
| 12 XII | LLLLRR | LLLRRL | LLRRLL | LRRLLL | RRLLLL | RLLLLR | 6 |
| 13 XIII | LLLLLR | LLLLRL | LLLRLL | LLRLLL | LRLLLL | RLLLLL | 6 |
| 14 XIV | LLLLLL | ——— | ——— | ——— | ——— | ——— | 1 |

| | Pentagon Subspecies | | | | | |
|---|---|---|---|---|---|---|
| Types | ABCDE | BCDEA | CDEAB | DEABC | EABCD | "Looks" |
| 15 XV | RRRRR | ——— | ——— | ——— | ——— | 1 |
| 16 XVI | LRRRR | RRRRL | RRRLR | RRLRR | RLRRR | 5 |
| 17 XVII | LLRRR | LRRRL | RRRLL | RRLLR | RLLRR | 5 |
| 18 XVIII | LRLRR | RLRRL | LRRLR | RRLRL | RLRLR | 5 |
| 19 XIX | LLLRR | LLRRL | LRRLL | RRLLL | RLLLR | 5 |
| 20 XX | LLRLR | LRLRL | RLRLL | LRLLR | RLLRL | 5 |
| 21 XXI | LLLLR | LLLRL | LLRLL | LRLLL | RLLLL | 5 |
| 22 XXII | LLLLL | ——— | ——— | ——— | ——— | 1 |

Pair's List

| Nr. | Pair | R or L | Nr. | Pair | R or L | Nr. | Pair | R or L |
|---|---|---|---|---|---|---|---|---|
| 1 | 1A-2A | R | 31 | 7D-24C | R | 61 | 14E-20C | R |
| 2 | 1B-5A | R | 32 | 7E-25B | R | 62 | 15B-32E | R |
| 3 | 1C-8A | L | 33 | 8C-26D | L | 63 | 15C-31E | L |
| 4 | 1D-11A | R | 34 | 8D-9A | R | 64 | 15D-16A | L |
| 5 | 1E-14A | L | 35 | 8E-29C | L | 65 | 15E-19C | R |
| 6 | 2B-14F | L | 36 | 8F-11B | L | 66 | 15F-20B | R |
| 7 | 2C-20D | R | 37 | 9B-26E | R | 67 | 16B-31F | L |
| 8 | 2D-3A | R | 38 | 9C-25E | R | 68 | 16C-30E | R |
| 9 | 2E-23C | L | 39 | 9D-10A | L | 69 | 16D-18C | L |
| 10 | 2F-5B | R | 40 | 9E-28C | R | 70 | 16E-19B | L |
| 11 | 3B-20E | R | 41 | 9F-29B | L | 71 | 17A-18A | R |
| 12 | 3C-19E | R | 42 | 10B-25F | L | 72 | 17B-21A | R |

-continued

Character Strings Table

| | | | | | | | | |
|---|---|---|---|---|---|---|---|---|
| 13 | 3D-4A | R | 43 | 10C-24E | R | 73 | 17C-24A | L |
| 14 | 3E-22C | R | 44 | 10D-27C | R | 74 | 17D-27A | R |
| 15 | 3F-23B | R | 45 | 10E-28B | L | 75 | 17E-30A | L |
| 16 | 4B-19F | R | 46 | 11C-29D | L | 76 | 18B-30F | L |
| 17 | 4C-18E | R | 47 | 11D-12A | R | 77 | 18D-19A | L |
| 18 | 4D-21C | R | 48 | 11E-32C | R | 78 | 18F-21B | R |
| 19 | 4E-22B | R | 49 | 11F-14B | L | 79 | 19D-20A | R |
| 20 | 5C-23D | R | 50 | 12B-29E | R | 80 | 21D-22A | R |
| 21 | 5D-6A | L | 51 | 12C-28E | L | 81 | 21F-24B | L |
| 22 | 5E-26C | R | 52 | 12D-13A | L | 82 | 22D-23A | L |
| 23 | 5F-8B | L | 53 | 12E-31C | R | 83 | 24D-25A | R |
| 24 | 6B-23E | L | 54 | 12F-32B | R | 84 | 24F-27B | R |
| 25 | 6C-22E | R | 55 | 13B-28F | L | 85 | 25D-26A | R |
| 26 | 6D-7A | R | 56 | 13C-27E | R | 86 | 27D-28A | R |
| 27 | 6E-25C | L | 57 | 13D-30C | L | 87 | 27F-30B | L |
| 28 | 6F-26B | R | 58 | 13E-31B | L | 88 | 28D-29A | L |
| 29 | 7B-22F | L | 59 | 14C-32D | R | 89 | 30D-31A | R |
| 30 | 7C-21E | L | 60 | 14D-15A | R | 90 | 31D-32A | R |

Identification Table

| Piece Nrs. | Side Letters ABCDEF | Sub-Species | | Set's Specification Type | Quantity |
|---|---|---|---|---|---|
| 1 | RRLRL— | XVIII | C * | Hexagons | |
| 2 | RLRRLR | V | B | I | 1 |
| 3 | RRRRRR | I | A | # II | 1 |
| 4 | RRRRR— | XV | A | III | 5 |
| 5 | RRRLRL | IV | D | IV | 3 |
| 6 | LLRRLR | VII | E | V | 2 |
| 7 | RLLRR— | XVII | B | | |
| 8 | LLLRLL | XIII | E | VI | 2 |
| 9 | RRRLRL | IV | D | VII | 2 |
| 10 | LLRRL— | XIX | E | VIII | 1 |
| 11 | RLLRRL | VII | F | IX | 0 |
| 12 | RRLLRR | III | C | X | 0 |
| 13 | LLRLL— | XXI | D | | |
| 14 | LLRRLL | VI | F | XI | 1 |
| 15 | RRLLRR | III | C | XII | 1 |
| 16 | LLRLL— | XXI | D | XIII | 1 |
| 17 | RRLRL— | XVIII | C * | XIV | +0 |
| 18 | RLLLRR | VI | B | Subtotal | 20 |
| 19 | LLRRRR | III | A | | |
| 20 | RRRRR— | XV | A | Pentagons | |
| 21 | RRRRLL | III | E | XV | 3 |
| 22 | RRRLRL | IV | D | XVI | 1 |
| 23 | LRLRL— | XX | E | XVII | 1 |
| 24 | LLRRRR | III | A | * XVIII | 2 |
| 25 | RRLRRL | V | C | | |
| 26 | RRRLR— | XVI | D | XIX | 1 |
| 27 | RRRRRL | II | F # | XX | 1 |
| 28 | RLRLLL | XI | D | XXI | 3 |
| 29 | LLLLR— | XXI | A | XXII | +0 |
| 30 | LLLRRL | XII | F | Subtotal | 12 |
| 31 | RLRRLL | VIII | E | Pieces | 32 |
| 32 | RRRRR— | XV | A | Grand Total | |

I claim:

1. An assembly puzzle having a hollow geometric assembled form comprised of a plurality of nominally regular polygon panels, each of said polygon panels including a plurality of edges, each of said edges including a groove extending longitudinally therein, said groove having opposed first and second end portions, means for joining edges of adjacent polygon panels in confronting relationship, including a plurality of cylinders, each groove in each edge of each of said panels having a portion adapted to fixedly secure one of said cylinders and another portion adapted to removably receive one of said cylinders extending from an adjacent panel, whereby complementary edges may be matingly engaged with the respective cylinders disposed in end-adjacent, axial alignment, means for releasably securing said cylinders disposed in end-adjacent, axial alignment, each of said polygon panels having a unique arrangement of cylinders secured to the edges thereof to define a limited number of polygon panel arrangements which can form the assembled puzzle.

2. The assembly puzzle of claim 1, wherein each of said plurality of polygon panels comprise an individual and separate puzzle piece.

3. The assembly puzzle of claim 1, wherein said plurality of polygon panels includes a plurality of first polygons and a plurality of second polygons.

4. The assembly puzzle of claim 3, wherein said first polygons each comprise a hexagon, and said second polygons each comprise a pentagon.

5. The assembly puzzle of claim 1, wherein each of said plurality of cylinders comprises a hollow tubular member having a bore extending axially therethrough, whereby matingly engaged confronting edges of adjacent polygon panels have respective cylinders disposed in end-adjacent fashion with the bores of the end-adjacent cylinders in axial alignment.

6. The assembly puzzle of claim 5, further including a plurality of locking pins, each dimensioned to be received in the axially aligned bores of two end-adjacent cylinders of a pair of matingly engaged confronting edges of adjacent polygon panels.

* * * * *